United States Patent [19]

Randle et al.

[11] Patent Number: 4,509,303

[45] Date of Patent: Apr. 9, 1985

[54] OVERLOAD PROTECTOR FOR GUYED STRUCTURES

[75] Inventors: Ronald E. Randle; Arnold M. Milbright, both of Red Wing, Minn.

[73] Assignee: International Telephone and Telegraph Corp., New York, N.Y.

[21] Appl. No.: 471,824

[22] Filed: Mar. 3, 1983

[51] Int. Cl.[3] ..... E04B 1/00

[52] U.S. Cl. ..... 52/98; 52/149; 188/375

[58] Field of Search ..... 52/98, 99, 148, 149; 188/371, 375, 376

[56] References Cited

U.S. PATENT DOCUMENTS

| | | | |
|---|---|---|---|
| 1,685,716 | 9/1928 | Mullen | 52/148 |
| 2,309,041 | 1/1943 | Booker et al. | 52/98 X |
| 3,504,460 | 4/1970 | Solberg | 52/98 |

*Primary Examiner*—Carl D. Friedman

*Attorney, Agent, or Firm*—Donald J. Lenkszus

[57] ABSTRACT

A device is described which operates as a "mechanical fuse" in a guy arrangement such that when loading forces on the guyed structure exceed a predetermined level, the device will add length to the guy arrangement. The device includes two plates coupled by a hinge bolt and a shear bolt. When the force exceeds the predetermined level, the shear bolt is severed by the plates allowing the plates to "scissors" open about the hinge bolt.

14 Claims, 4 Drawing Figures

OVERLOAD PROTECTOR FOR GUYED STRUCTURES

BACKGROUND OF THE INVENTION

This invention pertains to apparatus for use with guyed structures such as electrical transmission towers and the like.

In certain guyed structures it is desirable to provide overload protection in the guying system.

SUMMARY OF THE INVENTION

In accordance with the principles of the invention, a device is provided for introducing additional length in a guy system when a predetermined load is exceeded.

In the illustrative embodiment, the device comprises two plates pivotally coupled together at one end by a heavy duty hinge bolt and coupled together at the other end by a relatively soft "shear bolt". Holes are located in the plates for attachment to the guy arrangement. The device is connected serially in the guy arrangement and as long as the load in the guy arrangement is below a predetermined level, the plates are held together by the hinge bolt and the shear bolt.

When the load is at or exceeds the predetermined level, the shear bolt is severed by the two plates and the rigid connection between the two plates is thereby broken. The two plates will then pivot away from each other about the hinge bolt, thereby introducing additional length to the guy system.

BRIEF DESCRIPTION OF THE DRAWINGS

The invention may be better understood by a reading of the following detailed description in conjunction with the drawings in which.

DETAILED DESCRIPTION

Figure 2:
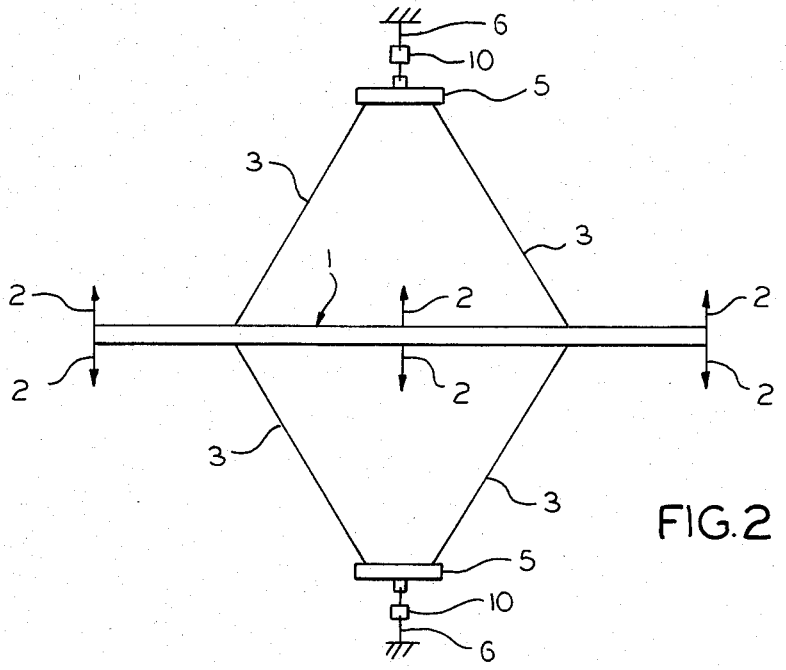
FIG. 2 is a top view of the structure of FIG. 1
Figure 1:
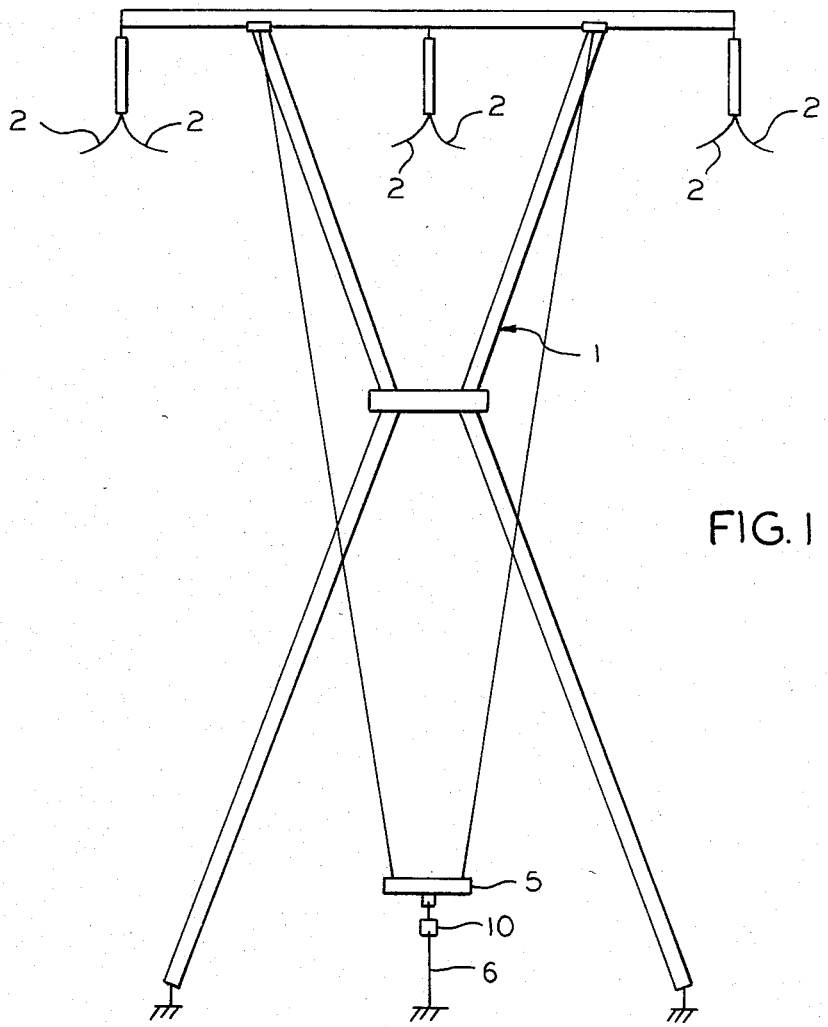
FIG. 1 illustrates a device in accordance with the invention utilized in a representative guying system.

The transmission structure of FIG. 1 includes a tower 1 for supporting electrical transmission lines 2.

A pair of guy lines 3 are each attached to one side of the tower and extend downward to a yoke 5. Each yoke 5 serves to couple its pair of guy lines to a single anchor guy 6 which is secured to a conventional anchor 7. Inserted between the yoke and the anchor guy is a device 10 in accordance with the principles of the invention.

Figure 3:
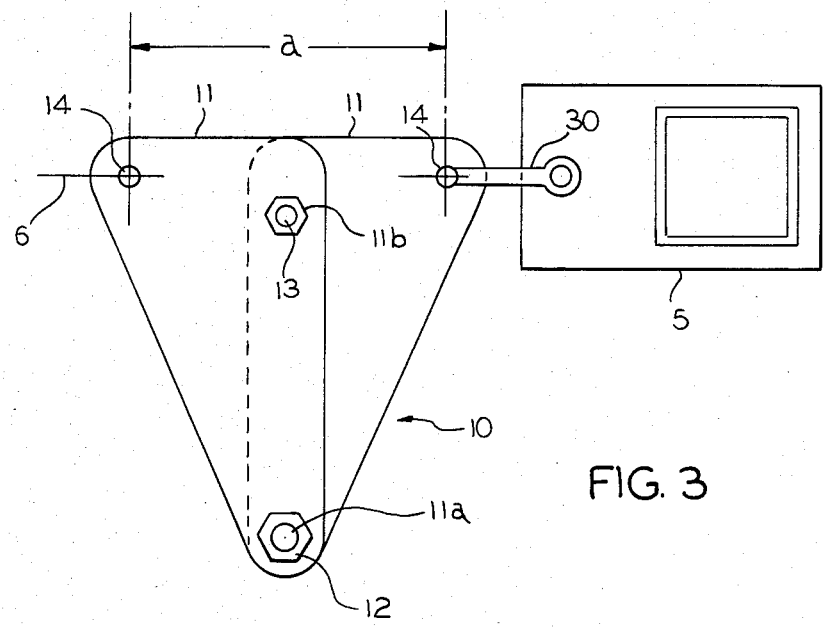
FIG. 3 illustrates a device in accordance with the principles of the invention in a "closed" position.
Figure 4:
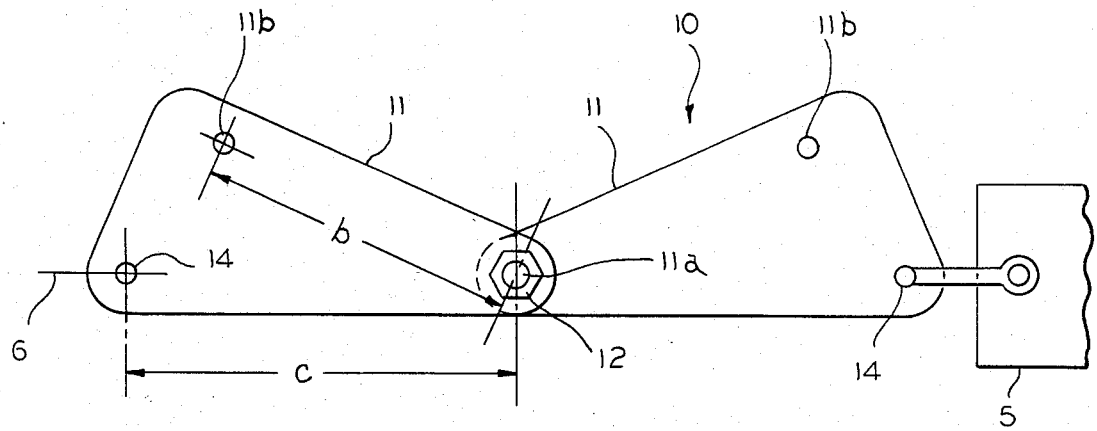
FIG. 4 illustrates the device of FIG. 3 in an "open" position.

Device 10, shown more clearly in FIG. 3 includes two triangular plates 11. Plates 11 are bolted together at one end through apertures 11*a* by a hinge bolt 12 and nut and at the other end by a softer shear bolt 13 through apertures 11*b* and a nut. The plates 11 each include an aperture 14 for connection to a guy system. Any conventional arrangement for coupling the device 10 serially in a guy system may be used. For example, the device 10 may be coupled to a yoke by means of a clevis or shackle 30 inserted through one aperture 14 and coupled to an anchor guy via a clevis or shackle through other aperture 14. The shear bolt 13 is selected such that it will be sheared by the plates 11 when a predetermined force is exerted on the plates 11. When bolt 13 is sheared, the hinge bolt 12 provides a pivot connection between the plates 11 such that the plates 11 will scissor open to the position shown in FIG. 3. When the plates 11 open, the length of the guy system is lengthened by a distance c equal to twice the distance between the hinge bolt 12 and the shear bolt 13 minus the distance a.

The distances a, b and c are determined for the specific application of the device. Typical ranges for these distances are:

a=4 to 24 inches;
b=3 to 48 inches; and
c=6 to 48 inches and typically the thickness of the plates 11 may range from $\frac{1}{4}$ to $1\frac{1}{4}$ inch.

One device 10 which was designed to open at a nominal force of 13,000 pounds utilized plates 11 of $\frac{1}{2}$ inch structural plate meeting ASTM standard A-588 having a yield strength of 65,000 pounds per square inch. Dimensions a, b and c were a=6 inches, b and c=12 inches.

Hinge bolt 12 was selected as a galvanized one inch diameter, $2\frac{1}{2}$ inch long bolt meeting ASTM standard A-325. A corresponding nut was used and bolt 12 was tightened to a torque of 50 foot pounds.

Shear bolt 13 was a 5/8 inch diameter, $2\frac{1}{4}$ inch long SAE grade 2 bolt having a tensile strength of 60,000 pounds per square inch. A hex nut was used and bolt 13 was also tightened to a torque of 50 foot pounds.

With these specifications, the shear bolt 13 was severed at a load of 13,500 pounds±5 percent.

Thus, the device 10 provides a reliable "mechanical fuse" for guy systems serving to introduce additional length in the guy system when a predetermined load is exceeded. With such a "mechanical fuse" arrangement, the guy tensions are reduced at the expense of increased structure deflection, but catastrophic structure collapse is avoided.

What is claimed is:

1. A device for serial connection in a guy arrangement comprising:

a first plate adapted for coupling to said guy arrangement and having first and second apertures spaced apart a first predetermined distance;

a second plate adapted for coupling to said guy arrangement and having third and fourth apertures spaced apart said first predetermined distance;

a hinge bolt extending through said first and third apertures to pivotally couple said first and second plate;

a shear bolt extending through said second and fourth apertures to couple said first and second plates;

said hinge bolt and said shear bolt cooperatively holding said first and second plates in a fixed position relative to each other when forces exerted on said device are below a predetermined level, and said plates shearing said shear bolt when said forces are equal to or exceed said predetermined level whereby said first and second plates pivot around said hinge bolt to add a predetermined length to said guy arrangement.

2. A device in accordance with claim 1, wherein said predetermined load is determined by the shear strength of said shear bolt.

3. A device in accordance with claim 1, wherein said first plate has a fifth aperture spaced apart from said second aperture by a predetermined distance, said fifth aperture being adapted to receive a coupling to said guy arrangement; and said second plate has a sixth aperture spaced apart from said fourth aperture by said predetermined distance, said sixth aperture being adapted to receive a coupling to said guy arrangement.

4. A guy extension device for serial connection in a guy arrangement comprising:

a first plate adapted for coupling to said guy arrangement;

a second plate adapted for coupling to said guy arrangement;

first means for coupling said first and second plates;

second means for coupling said first and second plates;

said first and second means cooperatively maintaining said first and second plates in a fixed position relative to each other when forces coupled to said first and second plates by said guy arrangement are less than a predetermined force;

said first and second plates cooperatively shearing said first means when said predetermined force is exceeded whereby said second means permits pivotal relative movement of said first and second plates to a different relative position such that said device adds length in said guy arrangement when said first and second plates are in said different relative position.

5. In combination:

a vertical structure;

at least one guy line extending from said structure;

an anchor; and a guy extension device serially coupled between said guy line and said anchor, said guy extension device comprising:

first and second arms;

first means for coupling said first and second arms, second means for coupling said first and second arms, said first and second means being spaced apart a predetermined distance;

third means for coupling said first arm to said guy line;

fourth means for coupling said second arm to said anchor;

said first and second means cooperatively holding said first and second arms such that said third and fourth means are spaced apart a first predetermined distance when said guy line and said anchor transmit a force less than a predetermined force to said guy extension device, said first and second arms cooperatively severing said first means for coupling when said force is greater than said predetermined force, said second coupling means permiting pivotal movement of said first and second arms when said first coupling means is severed such that said third and fourth means are spaced apart a second predetermined distance.

6. A combination in accordance with claim 5, wherein said second predetermined distance is greater than said first predetermined distance.

7. A combination in accordance with claim 5, wherein said structure is an electrical transmission tower.

8. A combination in accordance with claim 5 comprising:

a second guy line extending from said structure, and a yoke coupled on one side to said one guy line and to said second guy line and coupled on the other side to said guy extension device.

9. A combination in accordance with claim 8, wherein said structure is an electrical transmission tower.

10. A guy extension device for use in a guy arrangement, said device comprising:

first and second arms;

first means for coupling said first and second arms;

second means for coupling said first and second arms, said first and second means being spaced apart a first predetermined distance;

third means for coupling said first arm in said guy arrangement;

fourth means for coupling said second arm in said guy arrangement;

said third and fourth means coupling said device in series with said guy arrangement;

said first and second means cooperatively holding said first and second arms such that said third and fourth means are spaced apart a first predetermined distance when said guy line and said anchor transmit a force less than a predetermined force to said guy extension device, said first and second arms cooperatively severing said first means for coupling when said force is greater than said predetermined force, said second coupling means permiting pivotal movement of said first and second arms when said first coupling means is severed such that said third and fourth means are spaced apart a second predetermined distance.

11. A device in accordance with claim 10, wherein said first arm is a first plate, and said second arm is a second plate.

12. A device in accordance with claim 11, wherein said third means is a shear bolt.

13. A device in accordance with claim 12, wherein said fourth means is a hinge bolt.

14. A device in accordance with claim 10, wherein said third means comprises an aperture in said first arm and said fourth means comprises an aperture in said second arm.

* * * * *